United States Patent [19]

Carlsson et al.

[11] Patent Number: 4,819,839

[45] Date of Patent: Apr. 11, 1989

[54] OPENING ARRANGEMENT ON PACKING CONTAINERS

[75] Inventors: Lars Carlsson, Blentarp; Kjell Martensson, Malmö; Hans-Georg Melle, Höör, all of Sweden

[73] Assignee: Tetra Pak International AB, Lund, Sweden

[21] Appl. No.: 708,824

[22] Filed: Mar. 6, 1985

[30] Foreign Application Priority Data

Mar. 23, 1984 [SE] Sweden ..... 8401616

[51] Int. Cl.[4] ..... B65D 47/10

[52] U.S. Cl. ..... 222/541; 222/566; 229/125.15; 229/125.33

[58] Field of Search ..... 222/153, 572, 56 C, 222/541; 221/25, 24, 27; 229/7 R, 17 R, 125.21, 125.15, 125.33; 206/626

[56] References Cited

U.S. PATENT DOCUMENTS

| | | | |
|---|---|---|---|
| 2,353,521 | 7/1944 | Steffens | 222/566 X |
| 3,650,458 | 3/1972 | Rausing | 229/17 R |
| 3,795,359 | 3/1974 | Rausing | 229/17 R X |
| 3,900,155 | 8/1975 | Rausing et al. | 229/17 R |
| 3,977,591 | 8/1976 | Martensson et al. | 229/7 R |
| 4,113,103 | 9/1978 | Carlsson | 229/7 R X |
| 4,126,263 | 11/1978 | Martensson | 229/17 R |
| 4,258,876 | 3/1981 | Ljungcrantz | 229/7 R X |
| 4,312,450 | 1/1982 | Reil | 229/7 R |

*Primary Examiner*—Joseph J. Rolla
*Assistant Examiner*—Gregory L. Huson
*Attorney, Agent, or Firm*—Burns, Doane, Swecker & Mathis

[57] ABSTRACT

An opening arrangement for packing containers comprising a prepunched opening which is covered by a tear-off cover strip and a pouring rim element positioned between a wall of the packing container and the cover strip. In one of the embodiments, the pouring rim strip has an edge portion which projected partially over the opening of the packing container and a liquid-tight layer is joined to both an inside surface of the packing container wall and the edge portion of the pouring rim strip, as well as to a portion of the cover strip positioned over the opening. The application of the pouring rim as well as the manufacture of the opening arrangement as a whole are facilitated by joining in advance the pouring rim in a detachable manner to the cover strip, so the cover strip and the pouring rim can be applied as a unit.

9 Claims, 2 Drawing Sheets

Fig. 4
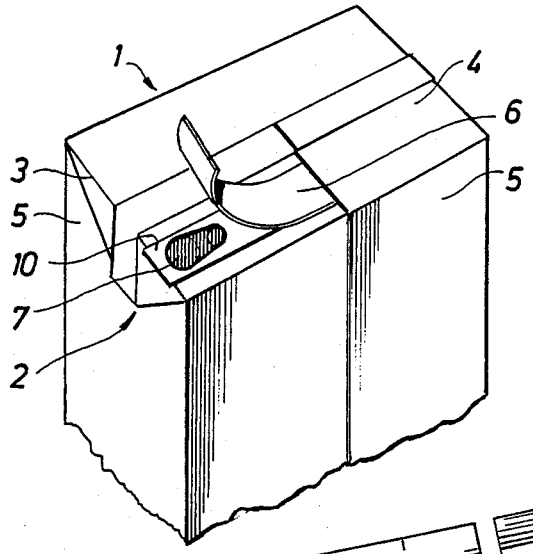
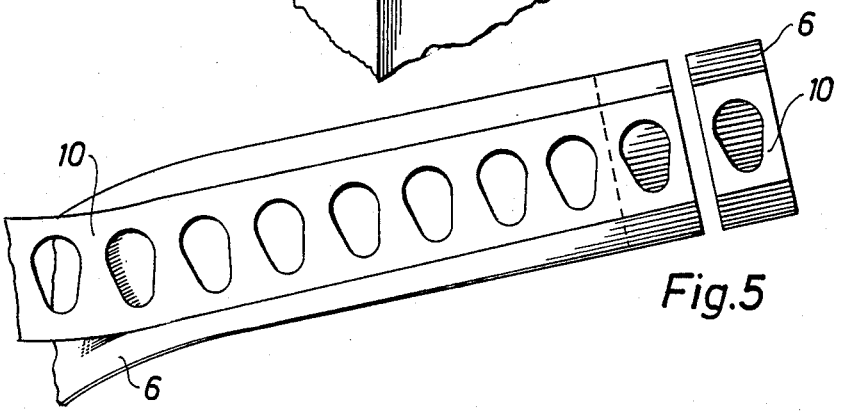
Fig. 5
Fig. 6
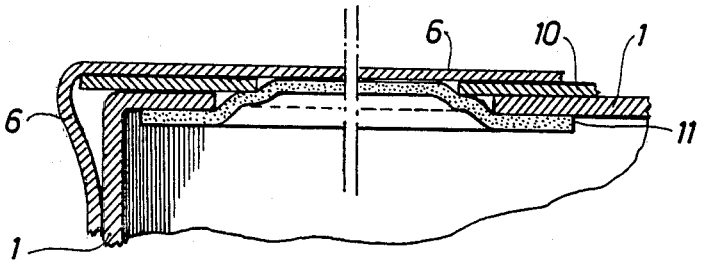

OPENING ARRANGEMENT ON PACKING CONTAINERS

FIELD OF INVENTION

The present invention relates to an opening arrangement for packing containers comprising a prepared pouring opening, a tearoff cover strip applied over the same, and a pouring rim situated between the cover strip and the wall of the packing container.

The invention also relates to a method for the application of a pouring rim to an opening arrangement on a packing container, this opening arrangement comprising a prepared pouring opening and a tear-off cover strip applied over the same.

BACKGROUND OF THE INVENTION

On the type of non-returnable packages (e.g. for beverages or other liquid foodstuffs) which are manufactured from a plastic-coated paper or other suitable packing laminate, a multitude of different types of opening arrangement are used to enable the emptying out of the packed contents. Opening arrangements of the type which comprise a prepared pouring opening and a tear-off cover strip applied over the same have obvious advantages from a point of view of handling and are encountered fairly frequently therefore on packing containers of the non-returnable type. Packing containers with this type of opening arrangement will be particularly simple to open through pulling off the strip covering and sealing the pouring opening. The opening arrangement also provides good pouring characteristics and most contents can be poured out simply at the required rate and in the form of a well concentrated and easily oriented jet.

To facilitate the pouring out of the contents it is generally preferred to place the pouring opening on the top side of the packing container near one of the edges which delimit the top side from the adjoining side walls. Moreover, the pouring opening is generally placed near a corner. Nevertheless difficulties occur when the packing container is newly opened and thus wholly filled with contents, since on leaving the pouring opening the contents have a tendency to "stick to" the outside of the packing material and run along it around the said packing container edge and all along the vertical side wall of the packing container. The problem is aggravated by the fact that the said packing container edge in most types of packing laminate has a slightly rounded shape and, therefore, does not form a sharply limited, natural pouring rim which could contribute to induce the contents "to let go" of the outside of the packing material.

A solution proposed earlier for eliminating this problem makes use of a loose collar or pouring rim which is applied to the side of the pouring opening where the contents are intended to pour out when the packing container is opened. By designing this collar or pouring rim in a suitable manner and ensuring that it has a sharp finishing edge which is separated from the underlying packing material very good pouring characteristics are made possible. However, the alignment and the attachments of the collar or pouring rim are difficult to realize in modern packing machines operating at high speed, since the collar is very small and has to be fixed with great precision in order to fulfil its purpose in a satisfactory manner. This makes necessary a further operating phase which renders the manufacture more expensive and further complicates the packing machines used.

Other solutions liable to overcome the abovementioned problem are also known and it has been proposed, among other things, to act upon the packing material with the help of e.g. chemical means in such a manner that the area situated around the pouring opening is given liquid-repellent properties so that the tendency of the outflowing jet of contents to follow the outside of the packing material is counteracted. Neither this nor other previously known solutions, however, have met with any great practical success.

OBJECTS AND SUMMARY OF THE INVENTION

It is an object of the present invention, therefore, to provide an opening arrangement for packing containers wherein the pouring opening and the area surrounding the pouring opening are of such a design and shape that the aforementioned disadvantages are eliminated and it becomes possible to pour out readily any types of contents occurring in a well concentrated and readily directable jet.

It is a further object of the present invention to provide an opening arrangement for packing containers which is of a design such that it is simple to manufacture and to apply and that it is well suited for automatic manufacture at high speed.

It is a further object of the present invention to provide a well functioning and readily applicable opening arrangement which can be used with its design substantially unchanged on different types and sizes of packing containers.

These and other objects have been achieved in accordance with the invention in that an opening arrangement of the type mentioned earlier has been given the characteristic that the pouring rim is joined to the cover strip as well as to the packing container wall by means of seals of different strength, the seal between the pouring rim and the cover strip being weaker than the seal of the pouring rim to the packing container wall.

By joining the pouring rim and the cover strip to each other it becomes possible to apply the pouring rim with great rapidity and precision in the desired condition to the packing container at the same time as the cover strip which substantially facilitates the manufacture and ensures greater accuracy and which has a favourable effect on the function as well as on the pouring characteristics of the opening arrangement. Owing to the differentiated adherence between pouring rim and cover strip and between pouring rim and packing container respectively it becomes possible to ensure that the pouring rim remains on the packing container when the cover strip is removed.

It is a further object of the present invention to provide a method for the manufacture of an opening arrangement of the type described earlier and especially a method for applying the pouring rim in the correct position in relation to the other parts in the opening arrangement.

It is a further object to provide a method for the application of the pouring rim and the cover strip which makes it possible rapidly and accurately to complete opening arrangements of the aforementioned type.

These and other objects have been achieved in accordance with the invention in that the method for the application of a pouring rim described earlier has been given the characteristic that the pouring rim is joined in a detachable manner to one side of the cover strip whereafter the cover strip and the pouring rim are applied and sealed to the packing container in such a manner that the pouring rim detaches itself from the cover strip and remains on the packing container when the cover strip is removed.

The method in accordance with the invention makes it possible to manufacture with great rapidity and precision units consisting of cover strip and pouring rim so that these parts can be applied thereafter in a simultaneous operation in the correct position to the pouring opening of the packing container.

BRIEF DESCRIPTION OF THE DRAWING

Preferred embodiments of the method as well as of the arrangement in accordance with the invention will now be described with closer reference to the attached schematic drawing which only shows the parts essential for an understanding of the invention.

FIG. 4 is a perspective view a part of a packing container to which a second embodiment of an opening arrangement in accordance with the invention has been applied.

FIG. 5 is a view of the manufacture of parts included in the opening arrangement according to FIG. 4.

FIG. 6 shows partly in section and in strong enlargement a part of an opening arrangement according to a second embodiment on the packing container according to FIG. 4.

DETAILED DESCRIPTION OF THE PREFERRED EMBODIMENTS

Figure 1:
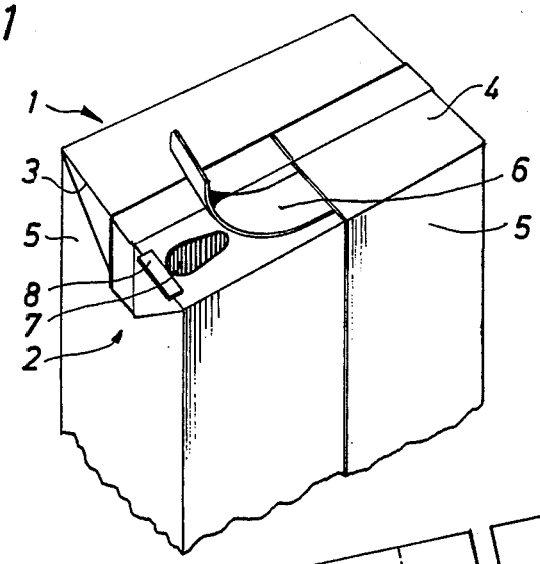
FIG. 1 is a perspective view a part of a packing container to which a first embodiment of an opening arrangement in accordance with the invention has been applied.

In FIG. 1 is shown a packing container with an opening arrangement in accordance with the first embodiment of the invention in opened condition. The packing container is of the TETRA BRIK (registered trade mark) type and is manufactured from a flexible laminate which comprises layers of paper and thermoplastics. The laminate is fed to a packing machine in web form, whereafter it is folded to a liquid-tight tube which is filled with the desired contents, e.g. milk. The tube is then processed with the help of sealing jaws which at equal intervals press the material tube flat so that its walls rest against each other in narrow transverse zones. The material is then heated with the help of the processing jaws in the said zones so that the thermoplastic layers fuse together, as a result of which the material tube is divided up into liquid-tight packing containers separated from one another. The liquid-tight packing containers so obtained are then severed from one another by transverse cuts through the sealing zones, whereupon they are subjected to a form processing which converts the cushion like packing container into substantially parallel-epipedic packing containers of the required appearance.

This known type of packing container described is often provided with an opening arrangement in the form of a prepunched hole and a cover strip applied over the hole. When the packing container is to be opened the cover strip is torn off and the hole functions as a pouring opening through which the packed contents can be emptied out. To ensure that the packing container is completely tight when the cover strip is untouched the opening arrangement generally comprises a further layer which is responsible for the tightness of the packing container and which prevents the contents from leaking out through the pouring opening and reaching the underside of the cover strip. This layer can be either in the form of a separate, liquid-tight strip which is sealed to the inside of the packing material in a liquid-tight seal extending around the pouring opening or else it may constitute one of the thermoplastic layers of the packing container and thus extend over the whole surface of the packing material. The latter embodiment can be produced in that the hole forming the pouring opening is punched out in conjunction with the manufacture of the laminate before the carrier layer of the packing laminate has been provided with the outer thermoplastic layers. In both embodiments the area of the liquid-tight layer located within the edge lines of the pouring opening is sealed to the underside of the cover strip which makes it possible for the liquid-tight layer to be torn at the same time as the cover strip is removed so that the contents become accessible.

As can be seen from FIG. 1 an opening arrangement 1 of the packing container 1 is generally placed in the vicinity of one of the edges 3 which delimit the top side 4 of the packing container from adjoining side walls 5. The opening arrangement 2 in accordance with the invention, like previously known types of opening arrangements, comprises a tear-off cover strip 6 (shown in FIG. 1) in partly removed condition) which covers a pouring opening 7 punched out of the packing material, the size and shape of which can be adapted to the type of contents for which the packing container is intended. Adjoining the pouring opening 7 is a collar or pouring rim 8 projecting over the adjoining edge line 3 of the packing container 1 which extends from the end of the pouring opening facing towards the edge 3 and a few millimetres out over the edge line 3 of the packing container.

Figure 3:
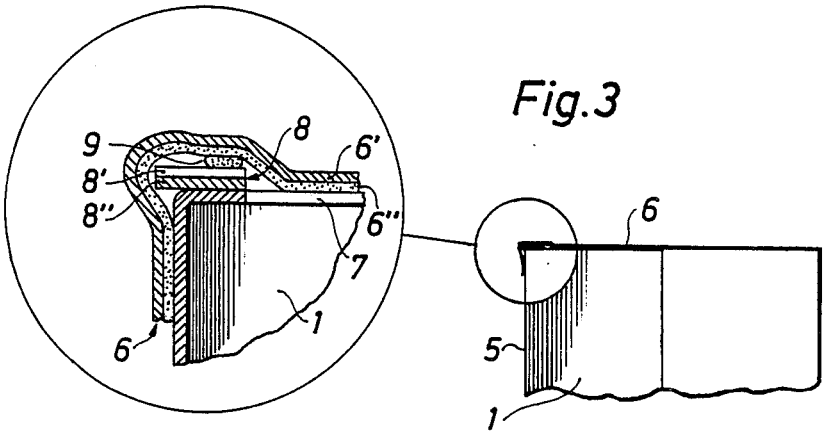
FIG. 3 is partly in section and partly enlargement of a part of an opening arrangement according to the first embodiment on the packing container according to FIG. 1.

The design of the pouring rim 8 and of the cover strip 6 is evident more clearly from FIG. 3 which in great enlargement illustrates the parts of the cover strip 6 and pouring rim 8 situated close to the edge 3 of the packing container.

As mentioned earlier the packing container 1 consists of a laminated material which comprises a central carrier layer of e.g. paper, one or more thermoplastic layers on either side of the carrier layer and possibly further layers of high gas-tightness, e.g. aluminium foil. The packing material may be of another type, however, and its structure is essentially of no importance for the opening arrangement in accordance with the invention, and for this reason the packing material is only shown schematically in FIG. 3 as consisting of a single layer. The cover strip 6 applied to the outside of the packing material also comprises a number of layers, namely a layer 6' of aluminium foil and a layer 6'' facing towards the packing container of thermoplastic material, e.g. polyethylene which is laminated to the aluminium foil 6'.

The pouring rim 8 too comprises two material layers, namely an outer layer 8' of polyvinyl chloride (PVC) and a layer 8'' facing towards the packing container and laminated to the layer 8' of a material which can be sealed to the outer layer of the packing container, that is to say preferably of polyethylene in those cases where the outside of the packing container is covered with a layer of polyethylene. Alternatively the inner layer 8" of the cover strip may consist of an ethylenevinyl acetate (EVA) if this is suitable for sealing to the outside of the packing material. It is also possible, of course, to use any form of hotmelt or a suitable sealing wax.

The cover strip 6 is sealed to the material of the packing container around the pouring opening and this is done simplest by heat sealing the layers of themoplastic material (polyethylene) of the cover strip and packing container material facing each other. At th same time the heat sealing of the bottom layer 8" of the pouring rim increases the adhesion to the packing container material so that the pouring rim will be firmly attached to the part of the packing container located between the pouring opening and the edge line 3. The cover strip 6 is also joined to the pouring rim 8 by means of a seal which preferably is achieved with the help of a sealing wax 9 which is applied between the cover strip and the pouring rim. This seal, however, may be of an appreciably lower strength than the seal between the pouring rim and the packing container. The sealing wax 9, moreover, is preferably applied only to a part of the surface of the pouring rim facing towards the cover strip, so that the pouring rim and the cover strip are sealed together only along the part of the pouring edge situated nearest the pouring opening 7. The part of the pouring edge 8 which extends beyond the edge line 3 of the packing container consequently is not sealed either to the cover strip 6 or to the material of the packing container as is clearly evident from FIG. 3. As a result the pouring rim will stay behind on the packing container when the cover strip is torn off and will form a free and well-defined rim or collar well capable of fulfilling its function as a pouring rim and preventing the poured contents from following the packing material and running along the side wall 5 when the packing container is to be emptied.

As mentioned previously the cover strip 6 is sealed to the packing material around the pouring opening 7 on the top side 4 of the packing container. With its front end, however, the cover strip 6 extends around the pouring rim 8 and down along the front side wall 5 of the packing container. The front end of the cover strip is sealed to the said side wall 5 at some distance below the pouring rim 8 which means that the pouring rim is protected during transport of the packing container and that any mistaken gripping of the projecting part of the pouring edge when the cover strip is to be removed is prevented.

Figure 2:
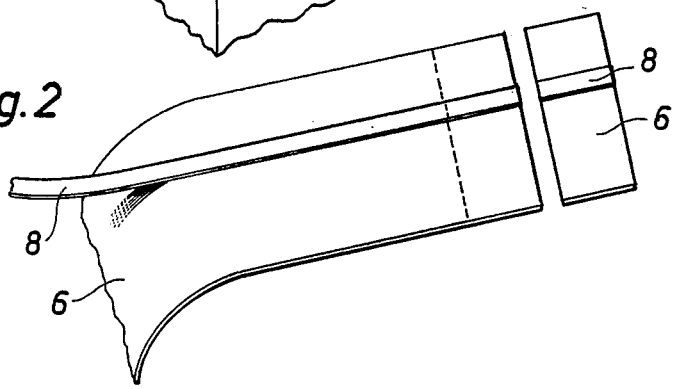
FIG. 2 is a view of the manufacture of parts included in the opening arrangement according to FIG. 1.

In the manufacture of a packing container with an opening arrangement in accordance with the invention the packing material is provided with a suitably placed pouring opening in conventional manner, whereupon the cover strip 6 and the pouring rim 8 are simultaneously applied and sealed to the packing container. A precondition for this is that the cover strip and the pouring rim can be handled as a unit which is made possible in that the cover strip and the pouring rim, while continuing to be in web form are joined in a detachable manner to each other by means of sealing wax 9 (FIG. 2). Subsequently the coherent cover strip and pouring rim webs are divided up by transverse cuts so that cover strips with applied pouring rims of the desired width are obtained. The said units consisting of cover strip and pouring rim then can be applied and sealed to the packing container or packing container material in such a manner that the pouring rim ends up in correct position along the front edge line of the pouring opening. The pouring edge 8 like the cover strip is sealed by heat sealing to the packing material, thus forming a seal which is appreciably stronger than the seal produced by means of sealing wax 9 between the pouring rim 8 and the cover strip 6.

To ensure further that the pouring rim 8 does not accompany the cover strip 6 when the latter is removed from the packing container it is possible to choose for the seal between the cover strip a sealing wax of the type which is detachable in moist environment, that is to say whose sealing strength will diminish above a certain degree of atmospheric moisture. This type of sealing wax will be successively affected by the moist environment in which the finished packing container is present, so that the attachment between the cover strip 6 and the pouring rim 8 ceases or is appreciably reduced already before the cover strip will be removed in connection with the opening of the packing container.

In FIG. 4 is shown an opening arrangement in accordance with the second embodiment of the invention applied to a parallelepipedic packing container of the said type in opened condition. Apart from the detailed design of the opening arrangement this second embodiment of the invention corresponds to the embodiment described earlier insofar as form of the packing container, placing of the opening arrangement, material types used etc. are concerned and identical reference designation have been chosen for corresponding parts wherever this was possible. The packing container 1 thus has its opening arrangement 2 placed on its top side, near one of the edges 3 which delimit the top side 4 of the packing container from the side walls 5. The tear-off cover strip 6 of the opening arrangement covers the pouring opening 7 and a pouring rim 10 which in this embodiment extends wholly or partly around the pouring opening 7 and is provided with an opening corresponding to the pouring opening. The pouring rim 10 like the pouring rim 8 in the first mentioned embodiment extends over the area located between the pouring opening 7 and the edge 3 and a few millimetres beyond the edge line 3 of the packing container.

The design of the pouring rim 10 and the cover strip 6 is evident more clearly from FIG. 6 which is a strongly enlarged cross-section of the part of the packing container provided with the opening arrangement. FIG. 6 is considerably simplified and does not show the different material layers included in the cover strip, the packing material etc. and, for the sake of clarity, the cover strip as well as the other materials are shown as consisting only of one homogeneous layer. However, in this embodiment as in the first embodiment described earlier it is a fact that the parts included consist of a number of different material layers which each can be substituted or varied within certain limits. This will be understood better if reference is made to the earlier parts of the description.

As is evident from FIG. 6, the pouring opening 7 provided in the packing laminate 1 is covered by means of a tear-off cover strip 6 which with a front gripping part extends around the edge line 3 of the packing container. Between the cover strip 6 and the wall material 1 of the packing container is the pouring rim 10 which extends not only along the part of the pouring opening which adjoins the edge line 3 but along the sides of the pouring opening and even, if this is desired, completely around the whole circumference of the pouring opening. The pouring rim thus may be in the form of a more or less C-shaped or semicircular piece of material, or else it may constitute a larger strip wherein an opening co-operating with the pouring opening is provided.

A particularly advantageous variant of this embodiment is obtained if the opening of the pouring rim 10 is made slightly smaller than the pouring opening 7. As a result of this the pouring rim will extend with a projecting part around the periphery of the pouring opening which makes it possible to join the projecting part of the pouring rim to an internal liquid-tight layer 11 in the packing container. The liquid-tight layer 11 may be constituted of the internal plastic layer of the packing laminate 1 or of a separate material strip which is joined in a liquid-tight manner to the packing material around the pouring opening 7. Moreover, the liquid-tight layer 11 is joined in the central part of the pouring opening 7 to the cover layer 6, so that this part of the liquid-tight layer 11 is torn free and accompanies the cover layer 6 when the latter is removed during the opening of the packing container. Since after the opening of the packing container this liquid-tight layer 11 continues to be joined to the part of the pouring rim 10 extending around the pouring opening the fibrous cut edge of the packing material 1 extending around the pouring opening 7 will be completely covered even after the opening which means that the contents present in the packing container can be poured out without making any contact with, or be absorbed by, the fibrous material layer. This is an appreciable advantage from a practical as well as hygienic point of view.

The second embodiment of the arrangement in accordance with the invention described above can also be modified further, e.g. in that part of the pouring rim delimiting the pouring opening is folded downwards so that it extends partly down into the pouring opening. As a result the capacity of the pouring edge to remain on the package is improved, at the same time as the fibrous cut edge of the packing material is further protected before, as well as after, the opening of the packing container.

For the rest the principle of operation for this embodiment is the same as for the first embodiment described earlier, that is to say the cover strip 6 is joined to the pouring edge 10 in such a manner that the seal between the cover strip and the pouring rim is weaker than the seal between the pouring rim and the wall of the packing container as a result of which the pouring rim will detach itself from the cover strip and remain on the packing container when the cover strip is removed.

The manufacture of a packing container according to this second embodiment too proceeds in a manner corresponding to that already described in connection with the first embodiment. Thus the cover strip and the pouring rim are handled as one unit during the manufacture, since the pouring rim and the cover strip whilst continuing to be web form have been joined in a detachable manner to each other as illustrated in FIG. 5. After division of the coherent cover strip and pouring rim webs by means of transverse cuts cover strips with applied pouring rim are obtained which subsequently can be applied and sealed to the packing material provided with pouring openings.

By means of the method and the arrangement in accordance with the invention it becomes possible in a rational and effective manner to provide packing containers with an opening arrangement which has a well functioning pouring rim, since any separate mechanical handling of the small pouring rim which is difficult to handle does not become necessary. The design of the opening arrangement is such that the cover strip can be removed from the front which has long been regarded as desirable in the packing industry but up to now has not been possible to combine with a projecting pouring rim.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. In an opening arrangement for a packing container of the type including a packing container wall having a pouring opening, a removable cover strip applied over said pouring opening and a pouring rim element situated between the cover strip and the packing container wall, wherein the improvement comprises the pouring rim element being joined to the cover strip by a first seal and said pouring rim element being joined to the packing container wall by a second seal, the first seal between the pouring rim element and the cover strip being weaker than the second seal between the pouring rim element and the packing container wall, said pouring rim element having an edge portion extending along said pouring opening, said edge portion projecting partially over said pouring opening, and a liquid-tight layer of material closing said pouring opening, said layer being joined to an inside surface of said packing container wall about said pouring opening and being joined to said edge portion and to said cover strip through said pouring opening, whereby upon opening of the packing container and pouring contents therefrom, said liquid-tight layer substantially prevents contents from being absorbed between said container wall and said rim element.

2. The opening arrangement in accordance with claim 1, wherein a side of the pouring rim element facing toward the wall of the packing container includes a material which can be heat sealed to said packing container wall.

3. The opening arrangement in accordance with claim 1 wherein the pouring rim element and the cover strip are sealed to each other by a layer of sealing wax which is detachable in a moist environment.

4. The opening arrangement in accordance with claim 1 wherein the pouring rim element extends beyond an adjacent edge line on the packing container.

5. The opening arrangement in accordance with claim 1, wherein a portion of the cover strip is spaced from the pouring rim element and is folded down and sealed to a side wall of the packing container at a location on the packing container lower than the location of the pouring rim element.

6. The opening arrangement in accordance with claim 1, wherein the liquid-tight layer is constructed from a separate material strip which is joined in a liquid-tight manner to the packing container material around the said pouring opening.

7. In a packing container of the type having a first wall and a second wall intersecting each other along a container edge, an opening arrangement comprising a first opening formed in said first container wall, a pouring rim strip having a first edge portion, a second opening spaced from said first edge portion and a second edge portion along said second opening, said pouring rim strip overlapping an outer surface region of said first container wall adjacent said first opening with said first edge portion positioned over said container edge and with said second opening positioned over said first opening such that said second edge region projects partially over said first opening, a first seal joining said pouring rim strip to said outer surface region, a cover strip overlapping an outer surface of said pouring rim strip, a second seal joining said cover strip to said outer surface of said pouring rim strip, said first seal stronger than said second seal so that said cover strip may be removed without removing said pouring rim strip, and a liquid-tight layer for closing said first opening, said liquid-tight layer joined to an inside surface region of said first container wall surrounding said first opening, said liquid-tight layer located in said first and second openings, said liquid-tight layer joined to said second edge region of said pouring rim strip and having a portion joined to an inner surface of said cover strip through said second opening such that as said cover strip is removed, said portion of said liquid-tight layer is substantially removed with said cover strip to open said container and a remaining portion of said liquid-tight layer remains joined to said second edge region and said inside surface region of said container wall to prevent contents of the container from contacting edges of said first container wall located along said first opening.

8. The packing container as claimed in claim 7, wherein said first rim portion of said pouring rim strip extends beyond said container edge and said cover strip includes an end portion folded over said first rim portion and sealed to said second wall.

9. The packing container as claimed in claim 8, wherein said inner surface of said cover strip is generally coplanar with said outer surface of said pouring rim strip adjacent said second opening.

* * * * *